United States Patent [19]

Olsson

[11] Patent Number: 4,671,599

[45] Date of Patent: Jun. 9, 1987

[54] SHIELDED ELECTRICAL CONNECTOR

[75] Inventor: Billy E. Olsson, New Cumberland, Pa.

[73] Assignee: AMP Incorporated, Harrisburg, Pa.

[21] Appl. No.: 823,134

[22] Filed: Jan. 27, 1986

Related U.S. Application Data

[63] Continuation of Ser. No. 666,573, Oct. 30, 1984, abandoned.

[51] Int. Cl.[4] ..... H01R 31/08; H01R 13/648

[52] U.S. Cl. ..... 439/188; 439/295; 439/610

[58] Field of Search ..... 339/143 R, 19, 222

[56] References Cited

U.S. PATENT DOCUMENTS

| | | | |
|---|---|---|---|
| 3,771,104 | 11/1973 | Clark | 339/98 |
| 4,018,979 | 4/1977 | Young | 339/143 R |
| 4,235,501 | 11/1980 | Ericsson | 339/176 M |
| 4,310,213 | 1/1982 | Fetterolf, Sr. et al. | 339/103 M |
| 4,337,989 | 7/1982 | Asick et al. | 339/143 R |
| 4,449,778 | 5/1984 | Lane | 339/107 |
| 4,501,459 | 2/1985 | Chandler et al. | 339/222 |
| 4,508,415 | 4/1985 | Bunnell | 339/143 R |
| 4,582,376 | 4/1986 | Olsson | 339/19 |

*Primary Examiner*—Gil Weidenfeld
*Assistant Examiner*—Gary F. Paumen
*Attorney, Agent, or Firm*—Eric J. Groen; F. Brice Faller; Robert W. Pitts

[57] ABSTRACT

Fully shielded electrical connector for shielded cable comprises a terminal housing, upper and lower ground shields and upper and lower insulative cover parts. Lower shield has a pair of wings extending forward from respective sidewalls thereof through the housing. Each wing has a flange lying against the respective housing sidewall and a resilient tongue which extends beyond the sidewall for engaging the flange on the wing in a complementary connector. Parts are designed for ease of assembly without special tools. Lower ground shield has flanges flanking cable receiving opening in rear wall which fit flushly in cable receiving opening in rear wall of lower cover inserter member has cable receiving aperture therethrough which opens in dovetail slot which engages dovetail flanges on rear wall of lower housing to prevent overstressing openings in lower shield and housing when cable with contact ferrule is inserted therein.

7 Claims, 15 Drawing Figures

SHIELDED ELECTRICAL CONNECTOR

This application is a continuation of application Ser. No. 666,573, filed Oct. 30, 1984 now abandoned.

BACKGROUND OF THE INVENTION

The invention relates to a shielded electrical connector.

There is disclosed in U.S. Pat. No. 4,449,778 a shielded electrical connector assembly of the type having a forward mating portion and a rear cable connecting portion, the assembly comprising a terminal housing, upper and lower ground shields, and upper and lower insulative cover parts. The lower ground shield has a base panel with a pair of sidewalls and a rearwall upstanding therefrom and a forward contact portion extending away from said rearwall. The lower cover part has a base panel with a pair of sidewalls and a rearwall upstanding therefrom, the panel, sidewalls, and rearwall of said lower shield fitting against the panel, sidewalls, and rearwall of said lower cover when said connector is assembled. The forward contact portion fits against the housing, the housing having a terminal support platform flanked by a pair of upstanding sidewalls bridged by a hood toward the forward end thereof, the upper shield having forward contact portions which fit against the hood facing the platform, the forward contact portions of the upper shield engaging the forward contact portions of the lower shield when the connector is mated with a like connector.

The known connector, however, does not have continuous shielding along the sides thereof when mated with another connector. Grounding currents in the cable shield connected to one connector pass only through forward contact portions of the upper and lower shields. It has been discovered that mere proximity of shields in complementary mated connectors does not provide effective interference shielding, especially when high signal frequencies (on the order of 400 MHz) are involved.

SUMMARY OF THE INVENTION

According to the invention, therefore, a shielded electrical connector as described above is characterized in that the lower shield has a pair of wings extending forward from respective sidewalls thereof, the wings being assembled between respective sidewalls of the housing to lie between the terminal support platform and the hood. Each wing has a flange lying against the respective housing sidewall and a resilient tongue which extends beyond said sidewall for engaging the flange on the wing in a complementary connector. The shielding is thus electrically continuous around the junction when the connectors are mated, leaving no "holes" which could cause interference.

The inventive connector is also designed for economy of manufacture; coring of molded parts is accomplished in two orthogonal directions so that multicavity molds are possible.

The connector also offers ease of assembly. The lower shield is emplaced by moving into the rear of the housing and the lower cover part is then likewise emplaced by movement toward the rear until it latchably engages the housing to hold the lower shield in place.

Furthermore, the cable-receiving opening in the upstanding wall of the lower shield is flanked by a pair of integrally formed flanges which fit substantially flushly into the cable-receiving opening in the upstanding wall of the lower cover part. The lower cover part has a pair of parallel flanges flanking the opening therein on the outside surface of the upstanding wall thereof, the flanges being collectively profiled as a dovetail. The assembly further comprises an inserter member having an aperture therethrough, the aperture opening in a dovetail slot on a mating face of the inserter member, the dovetail slot being profiled to engage the dovetail flanges on the outer wall of the lower cover part by movement of the inserter member perpendicular toward the plane of the panel of the lower cover part. The assembly further comprises a metal contact ferrule profiled to fit between the individual conductors and the shield of a cable. Upon assembling the lower ground shield to the lower cover part, assembling the cable through the inserter member, stripping the outer insulation from the end protruding from the mating face to expose the cable, and inserting the ferrule between the individual conductors and the exposed cable shield, the exposed cable shield can be forced between the flanges of the lower shield when the dovetail slot in the inserter is mated with the dovetail flanges on the lower cover part.

The inventive connector provides the advantage of assured contact integrity between the lower shield and the cable shield, which upon mating with the complementary connector assures continuity of ground between shields of respective cables.

These and additional advantages will be readily understood by referring to the description and figures which follow.

DETAILED DESCRIPTION OF THE PREFERRED EMBODIMENT

Figure 1:
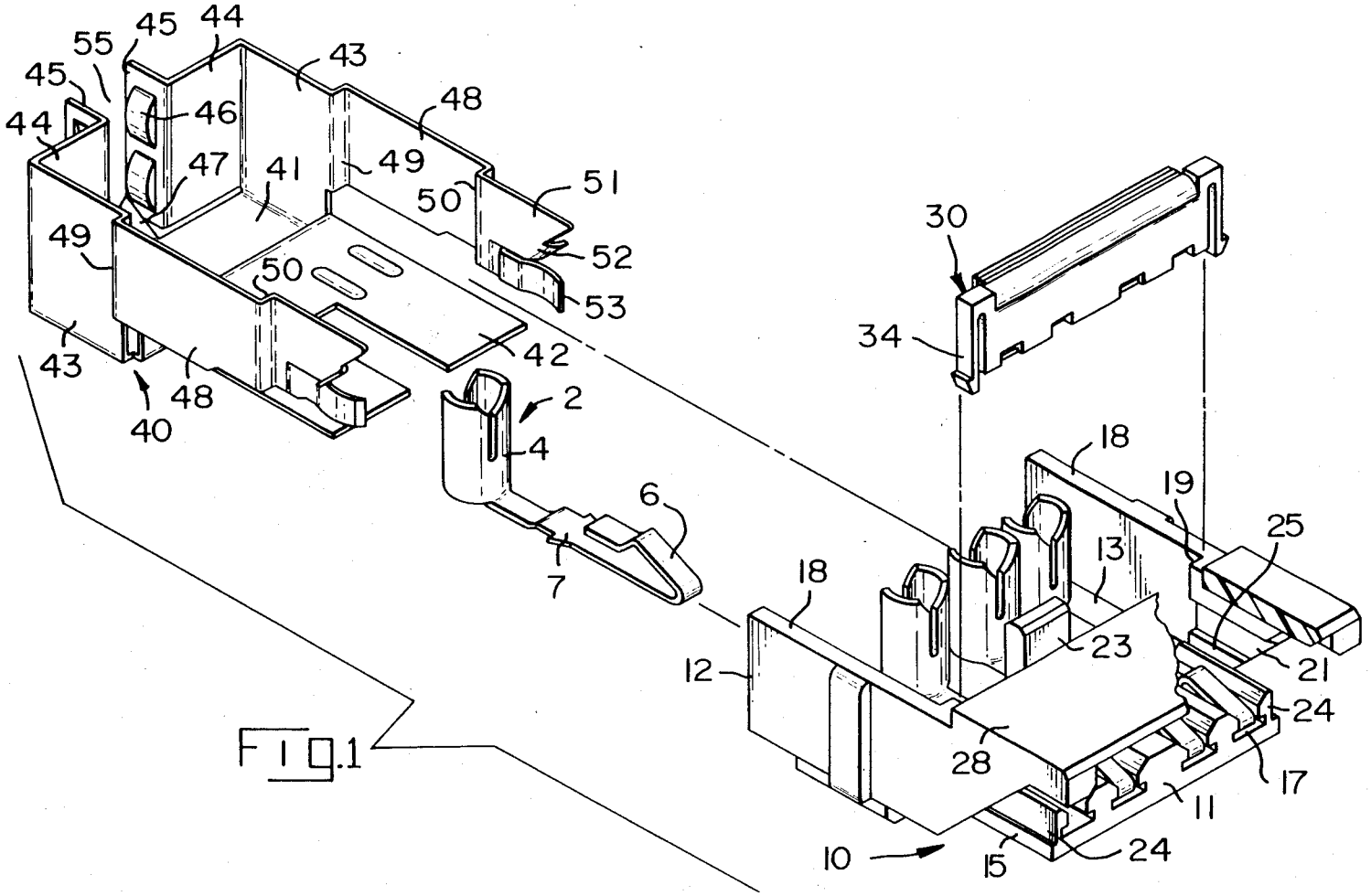
FIG. 1 is an exploded perspective of the housing, terminals, lower shield, and shunt assembly.

FIG. 1 shows a terminal housing 10 with which the assembly sequence begins. The housing 10 has a terminal support platform 13 extending from a front end 11 to a rear end 12 where terminals 2 are received. Each terminal 2 has a wire barrel 4, a mating tongue 6, and a base portion 7 extending therebetween; the base portion 7 is received in the respective channel 17 in the platform 13. The platform is flanked by sidewalls 18 upstanding therefrom, which sidewalls have rearward facing shoulders 19 on respective inside faces thereof and shielding channels 21 extending forward from the shoulders 19. Partitions 24 flank the inside faces of the sidewalls 18 forward of shoulders 19 and define slots 25 below channels 21. A hood 28 bridges the sidewalls 18 at this end. Shunt assembly 30 is shown poised for reception between shoulders 19 and a post 23 upstanding from the platform 13 between the two central channels 17.

Lower shield 40 comprises a base panel 41 from which integrally formed forward contact portion 42 extends and sidewalls 43 upstand. Rearwall portions 44 are formed from respective sidewalls 43 to flank base panel 41 and define a cable receiving opening 55 therebetween. Each rearwall portion 44 is formed with a flange 45 flanking opening 55, each flange 45 being formed with detents 46. A resilient tongue 47 extends from the panel 41 into opening 55. Forward wings 48 are formed from respective sidewalls 43 at respective first bends 49 which define rearward facing shoulders on opposed surfaces thereof. The wings 48 are also formed with second bends 50 defining forward facing shoulders on opposed surfaces thereof. A mating flange 51 and a resilient tongue 53 extend forwardly from each shoulder 50; the flange 51 has an outwardly curled lip 52 for mating with the tongue of a like connector.

Figure 2:
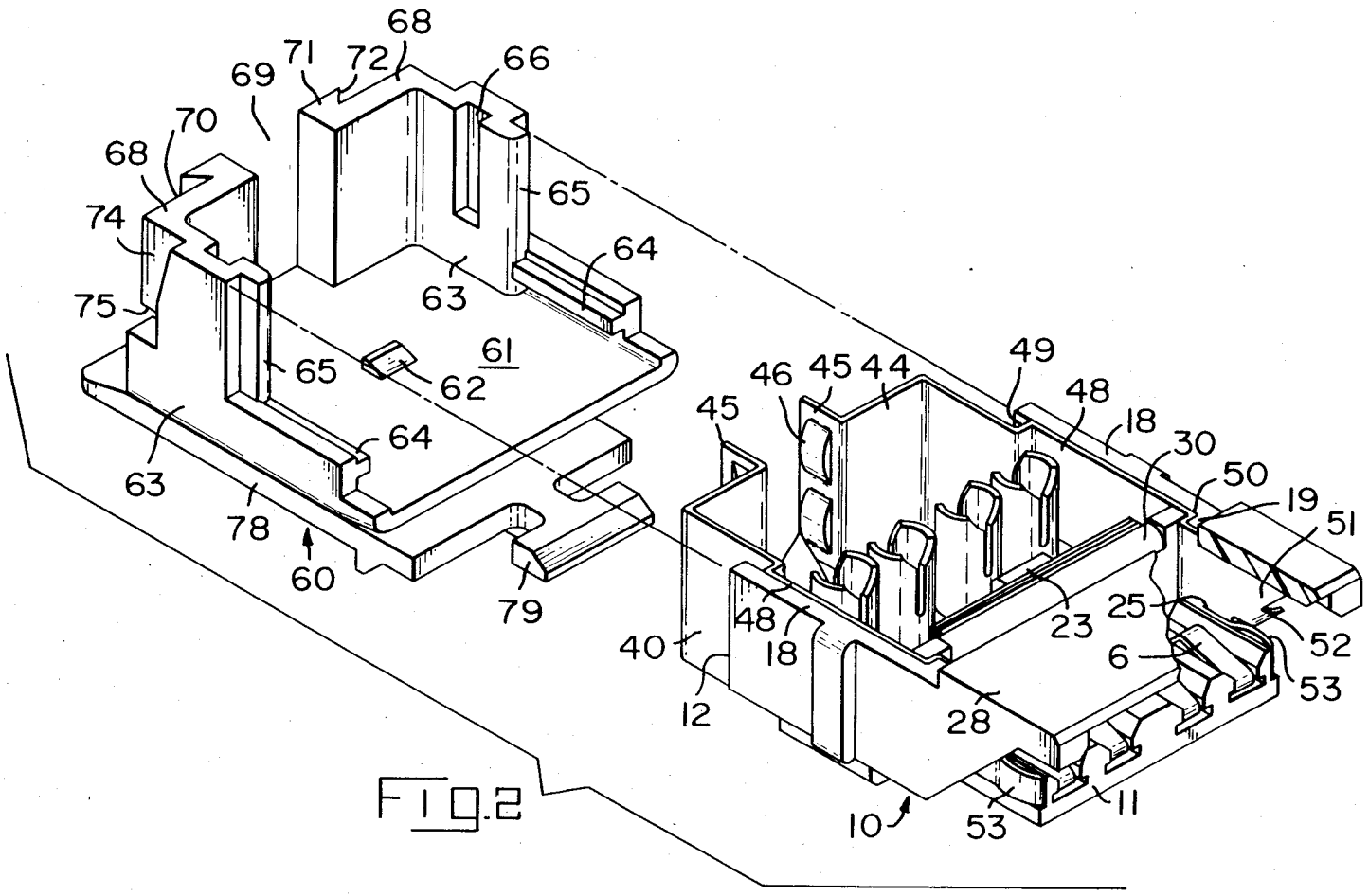
FIG. 2 is a perspective of the lower cover exploded from the assembled housing and lower shield.

FIG. 2 shows the lower shield 40 assembled to housing 10; forward wings 48 are flush against inside surfaces of sidewalls 18 in the housing and forward facing shoulders 50 on the shield abut rearward facing shoulders 19 on the housing. Tongues 53 lie in slots 25 with the flange 51 offset thereabove. The channel 21 (FIG. 1) allows passage of lip 52 therethrough during assembly. The shunt assembly 30 is latchably emplaced after the shield 40 is assembled to housing 10.

Figure 3:
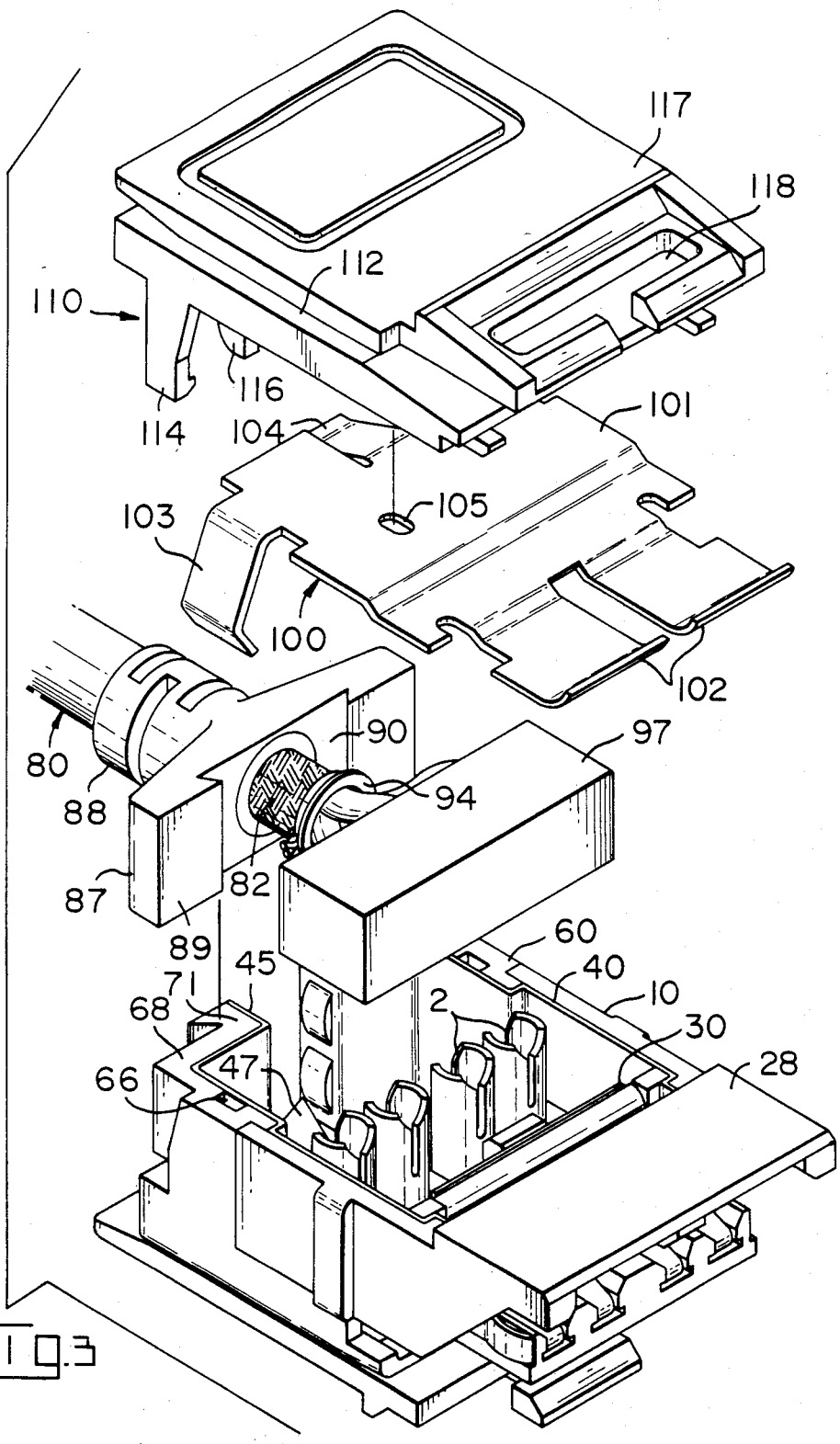
FIG. 3 is a perspective of the upper cover, upper shield, and inserter assembly exploded from the assembled housing, lower shield, and lower cover.

The lower cover 60 comprises a base panel 61 having integrally molded sidewalls 63 and rearwalls 68 upstanding therefrom. A latch 62 upstanding from the center of base 61 serves to retain the cover 60 with housing 10 (FIG. 7B). Sidewalls 63 have respective horizontal mating ribs 64 extending forwardly therefrom for mating with housing 10 (FIG. 7C) and vertical mating ribs 65 for reception between rear face 12 of housing 10 and shoulder 49 of lower shield 40. The rearwalls 68 define a cable opening 69 therebetween and have respective flanges 71 extending from outside surfaces 70 and flanking opening 69. The flanges 72 taken together are profiled as a dovetail intersected by opening 69. Notches 74 are formed at the interstice of each sidewall/rearwall pair, the notches 74 each having a shoulder 75 therein for retention of the upper cover 110 (FIG. 3). The latch arm 78 is molded with a T-member 79 for mating with a complementary connector.

FIG. 3 depicts the lower cover 60 assembled to the lower shield 40 and housing 10. The flanges 45 fit flushly against flanges 71 on rearwalls 68. The inserter assembly, shown in greater detail in FIGS. 6A and 6B, comprises cable 80, inserter member 87, and stuffer 97. The inserter member 87 comprises a rearward gripping portion 88 and a mating flange 89 which is profiled with a dovetail slot 90 for receiving the dovetail ridges 72 on the lower cover 60. A contact ferrule 94 is fit between individual insulated conductors 81 and braided shield 82 to insure good grounding contact between flanges 45 and the braid 82; detents 46 serve to retain ferrule 94.

An upper shield 100 comprises a base panel 101, forward contact tongues 102, and resilient side members 103 which are received against inside faces of respective sidewalls 43 on lower cover 40. Resilient tongue 104, like tongure 47 below, serves to contact braid 82. Upper cover 110 comprises a panel portion 112, lock arms 114, and a latch arm 117 having a T-slot 118 for retention with a complementary connector. Aligning posts 116 are received in channels 66; the rounded surfaces of posts 116 serve to cam the cover 110 forward to fit snugly against hood 28. The upper shield 100 is assembled to upper cover 110 by staking plastic studs in through holes 105 and assembled to lower cover 60 and housing 10 after inserter 87 and stuffer 97 are applied thereto by latching arms 114 with shoulders 75 in notches 74.

Figure 4:
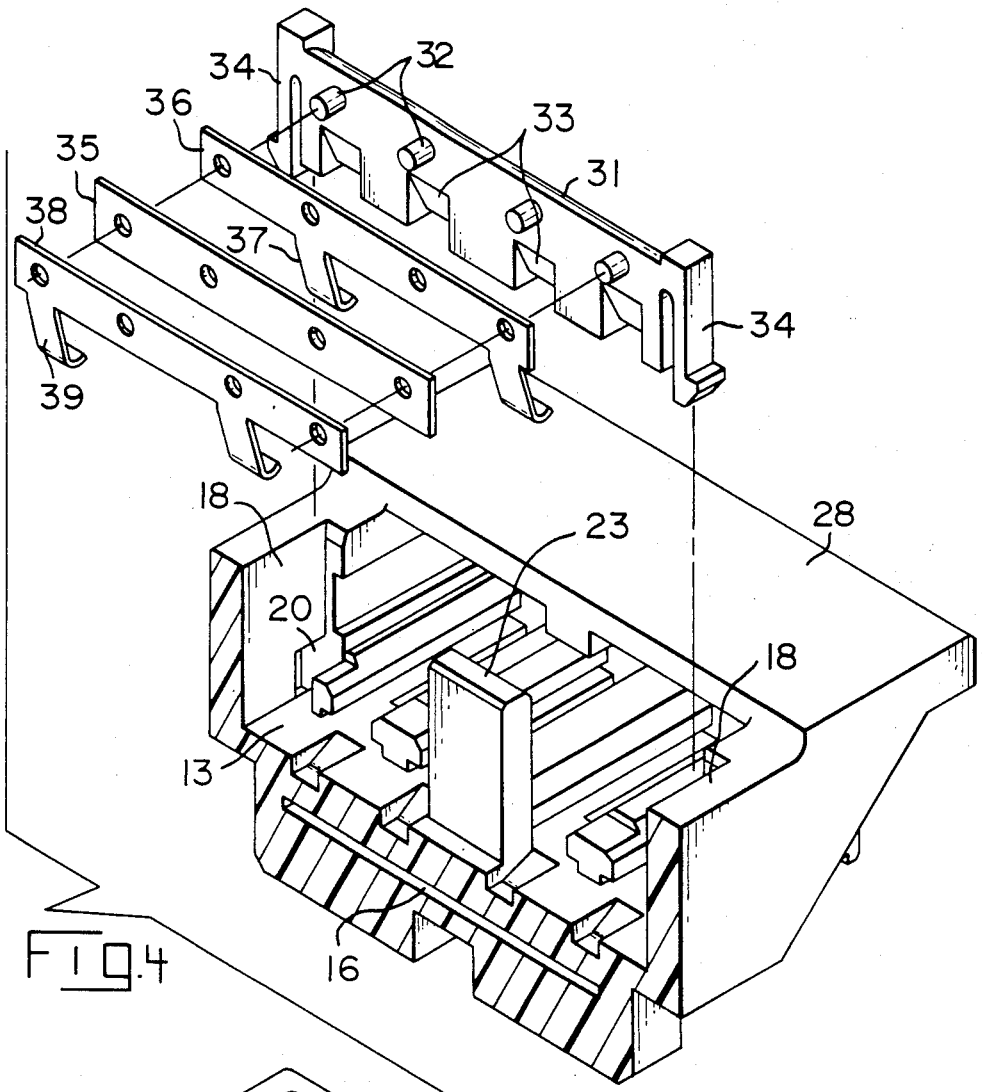
FIG. 4 is an exploded perspective of the shunt assembly and a sectioned portion of the housing.

FIG. 4 shows the exploded components of shunt assembly 30, which comprises a dielectric carrier 31, shunt members 36, 38 for bridging alternative terminals, and a dielectric spacer 35 therebetween. The carrier 31 has staking pegs 32 for fixing members 36, 38 thereto and channels 33 which permit flexure of the shunt contacts 37, 39. Latches 34 cooperate with apertures 20 in sidewalls 18 of housing 10 to retain the assembly 30 (FIG. 1) which is positioned between shoulders 19 and post 23. Note slot 16 in platform 13, which slot receives the forward contact portions 42 of lower shield 40 (FIG. 1).

Figure 5:
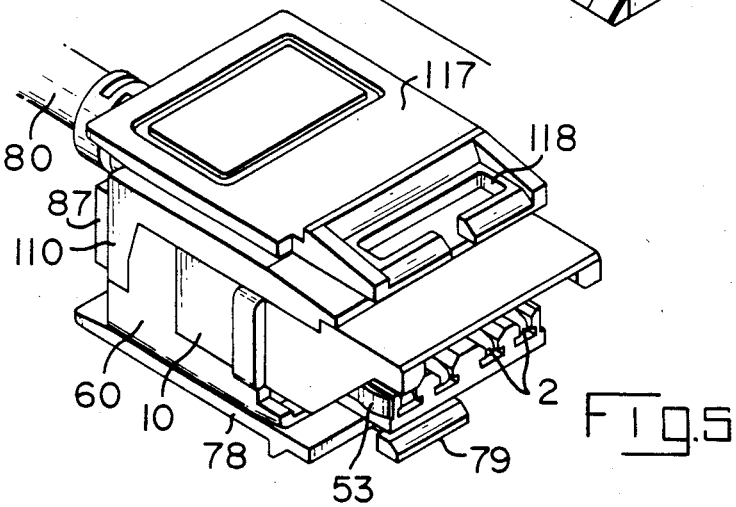
FIG. 5 is a perspective of the assembled connector.

The assembled connector is shown in FIG. 5; like the connector disclosed in U.S. Pat. No. 4,449,778, it is an hermaphroditic connector designed to mate with a like connector inverted so that T-bars 79 mate with T-slots 118. Further, the connector of the present invention is designed to mate with a connector of the type disclosed in U.S. Pat. No. 4,449,778; the resilient tongues 53, which mate with respective flanges 51 in a like connector, do not preclude mating with the prior art connector.

Figure 6A:
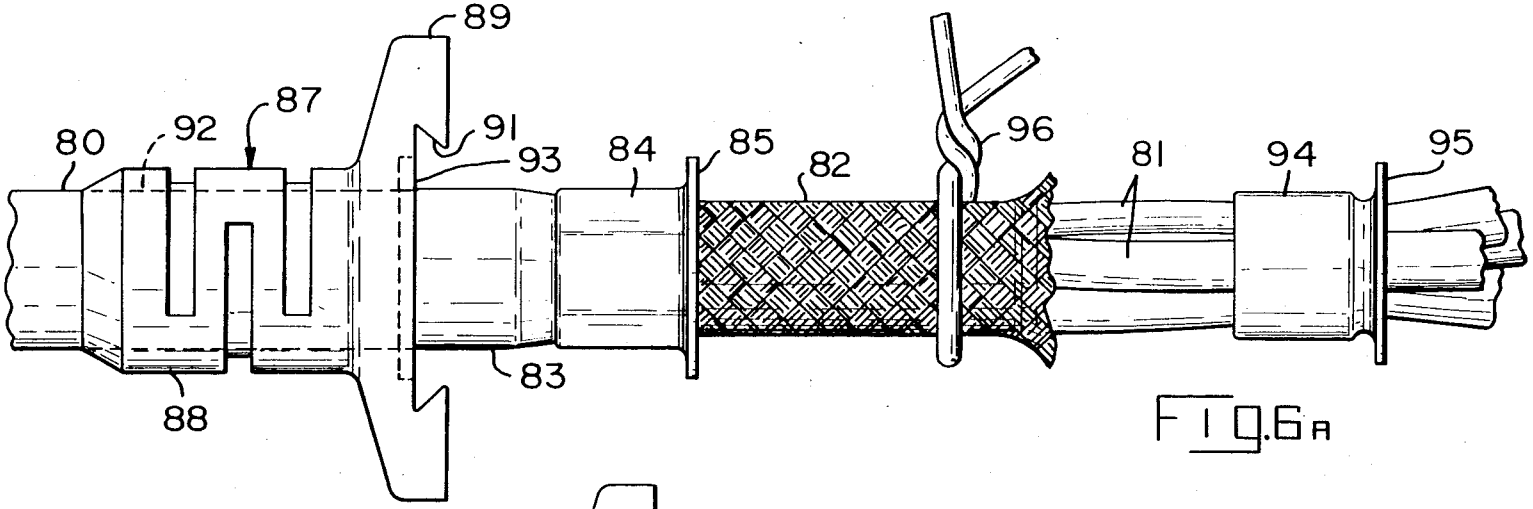
FIG. 6A is a plan view of the assembled cable, inserter, and strain relief ferrule before asssembling the contact ferrule and clamp.
Figure 6B:
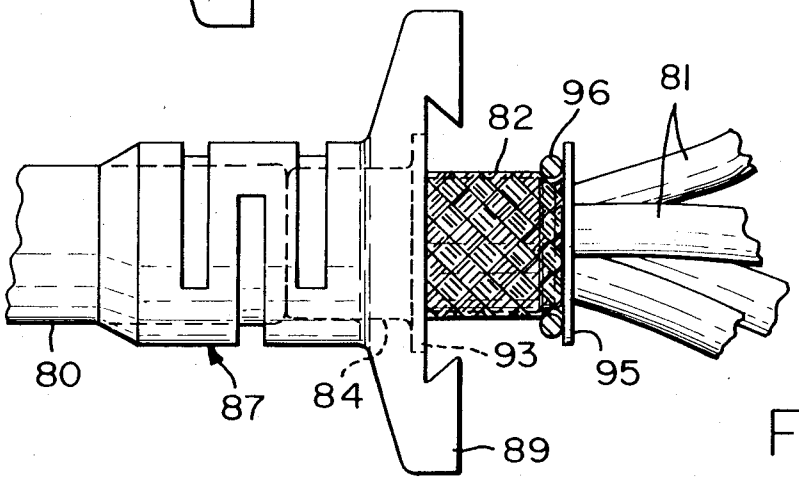
FIG. 6B is a plan view of the contact ferrule and clamp assembled to the cable.

FIG. 6A shows the inserter member having cable 80 fed through axial aperture 92 therein and emerging from mating flange 89. The insulation 83 is stripped to expose braid 82 and a strain relief ferrule 84 is crimped to the insulation 83 adjacent the exposed braid. Flange 85 on ferrule 84 is profiled to nest in countersink 93 in mating flange 89, as shown in FIG. 6B, thus preventing strain on the conductor terminations when axial force is applied on cable 80. Referring again to FIG. 5A, the contact ferrule 95 is shown loosely fit on exposed conductors 81. This is subsequently fit concentrically within braid 82, the clamp 96 is applied, and the braid trimmed as shown in FIG. 6B.

Figure 7A:
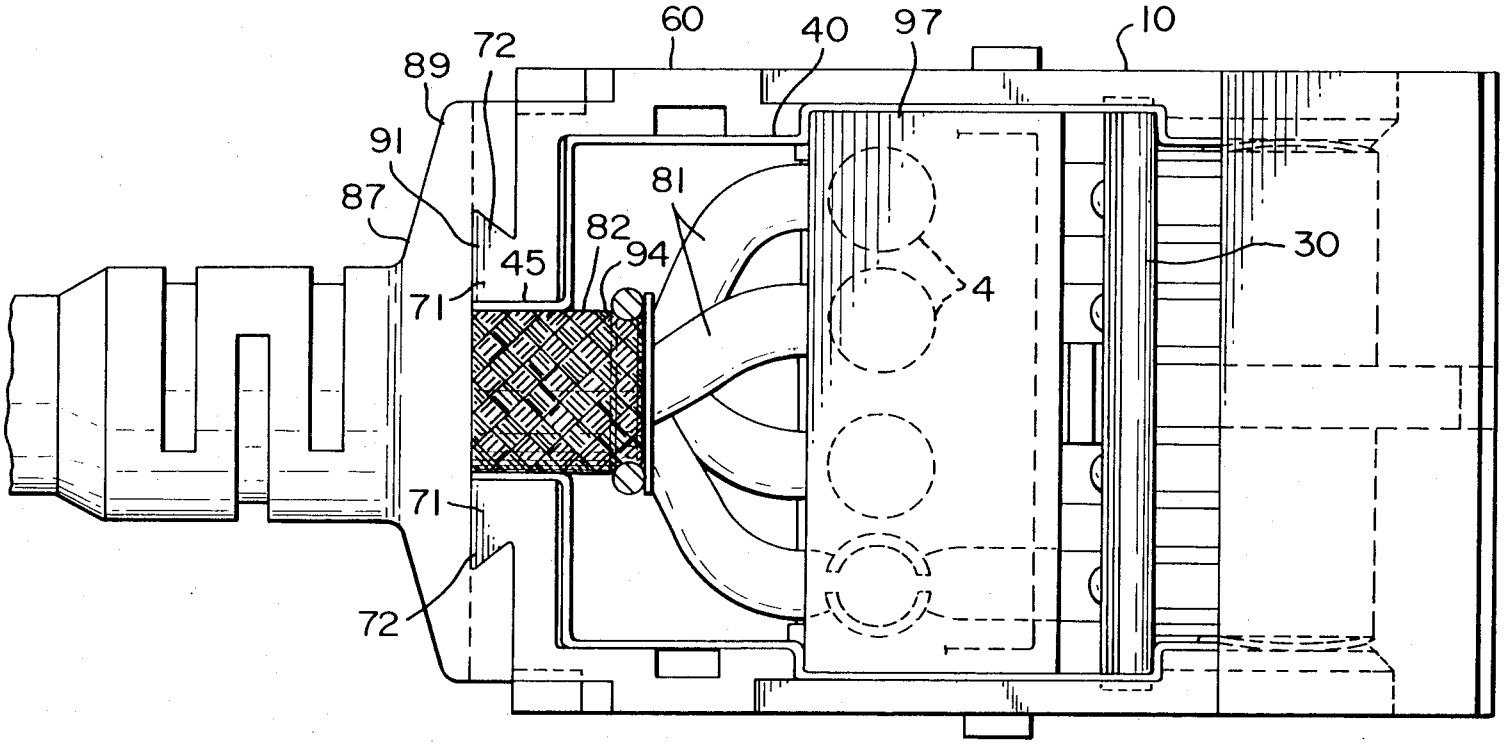
FIG. 7A is a plan view of the assembled connector.
Figure 7B:
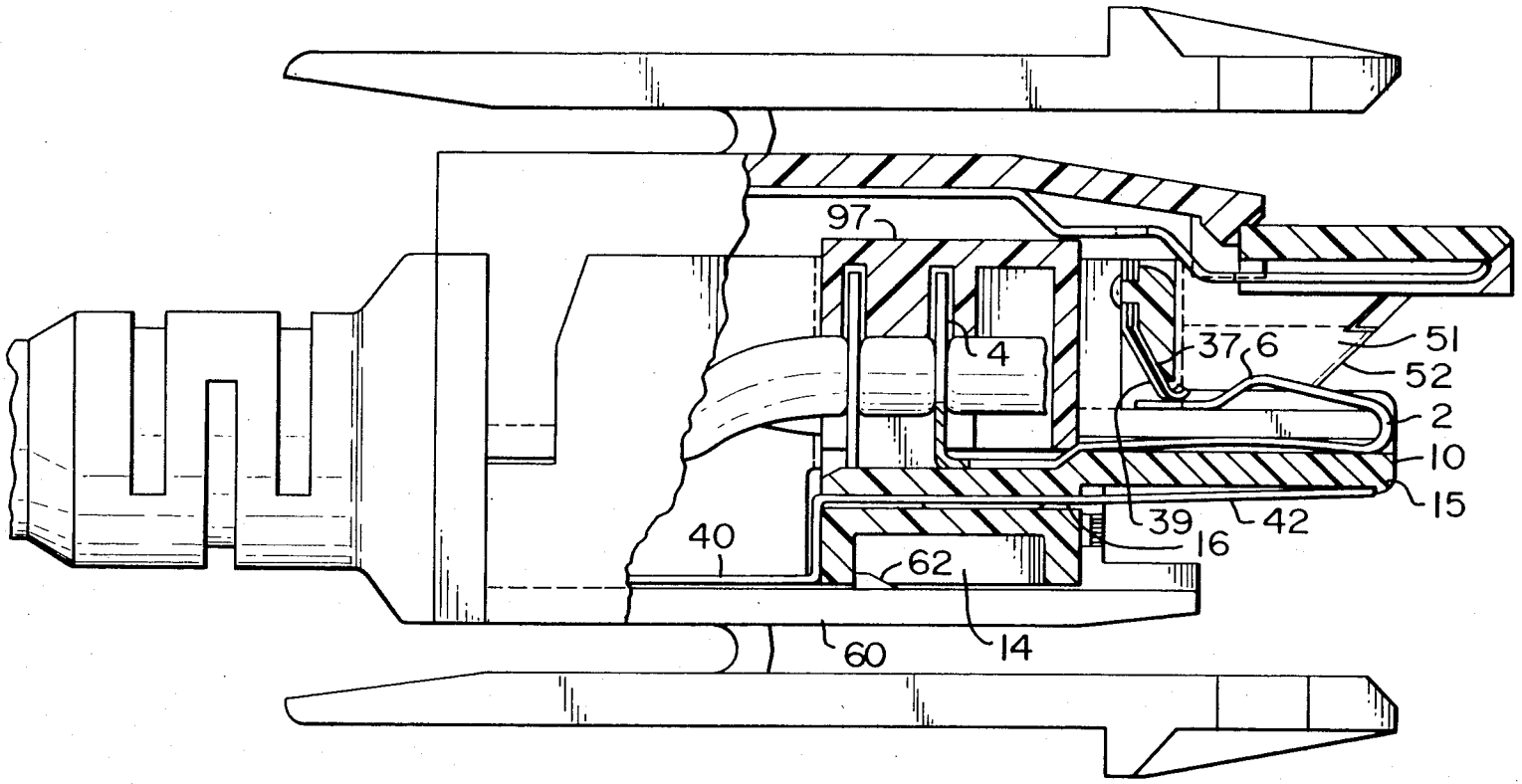
FIG. 7B is a side view of the assembled connector.

FIG. 7A is a plan view of the assembled connector with the upper cover removed. The stuffer 97 has been used to force the individual conductors 81 into the wire barrels 4 of the terminals 2 in conventional fashion. The shunt assembly 30 is emplaced to electrically connect alternate tongues 6 as described in U.S. patent application Ser. No. 597,862, filed Apr. 9, 1984. The dovetail slot 91 on mating flange 89 of inserter member 87 is engaged with dovetail flanges 72, offering a major advantage of the inventive connector, to wit, compressive force is maintained on the contact ferrule 94 within braid 82. This assures that the electrical contact between the braid 82 and lower ground shield 40 will be maintained, while contact forces tend to relax in known prior art arrangements.

FIG. 7B is a partial side section view of the assembled connector. This view details the cooperation between housing 10, lower shield 40, and lower cover part 60. The housing 10 has a terminal support platform 13 with a forward extension 15 and an opposed bottom recess 14. A shield slot 16 extends through the housing 10 and receives forward contact portions 42 of lower shield 40 therethrough to lie below extension 15. The contact portions 42 so emplaced provide mating surfaces for contact tongues 102 of an upper shield 100 in a complementary connector. The lower cover part 60 protects the base panel 41 of lower shield 40 and is held in place by cooperation of latch 62 in recess 14.

Figure 7C:
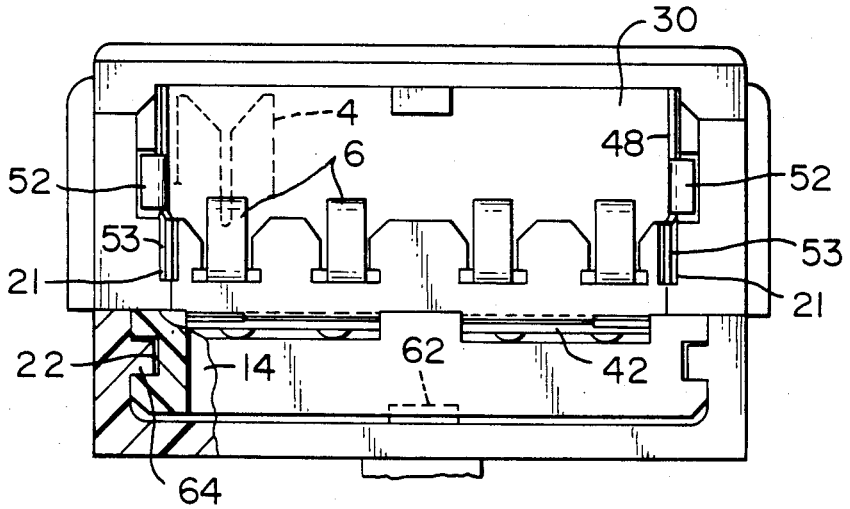
FIG. 7C is a mating end of the assembled connector without the top cover.

FIG. 7C is an end view showing the cooperation between ribs 64 on lower cover 60 and channels 22 in housing 10 which serves to support the two parts in mated condition. The forward wings 48 of lower shield 40 are shown emplaced against sidewalls 18 with the tongues 53 in respective slots 25 and extending therebeyond (FIG. 2) for mating against the flange 51 of a like shield in a complementary connector. The lip 52 is formed outward to permit mating without interference.

Figure 8:
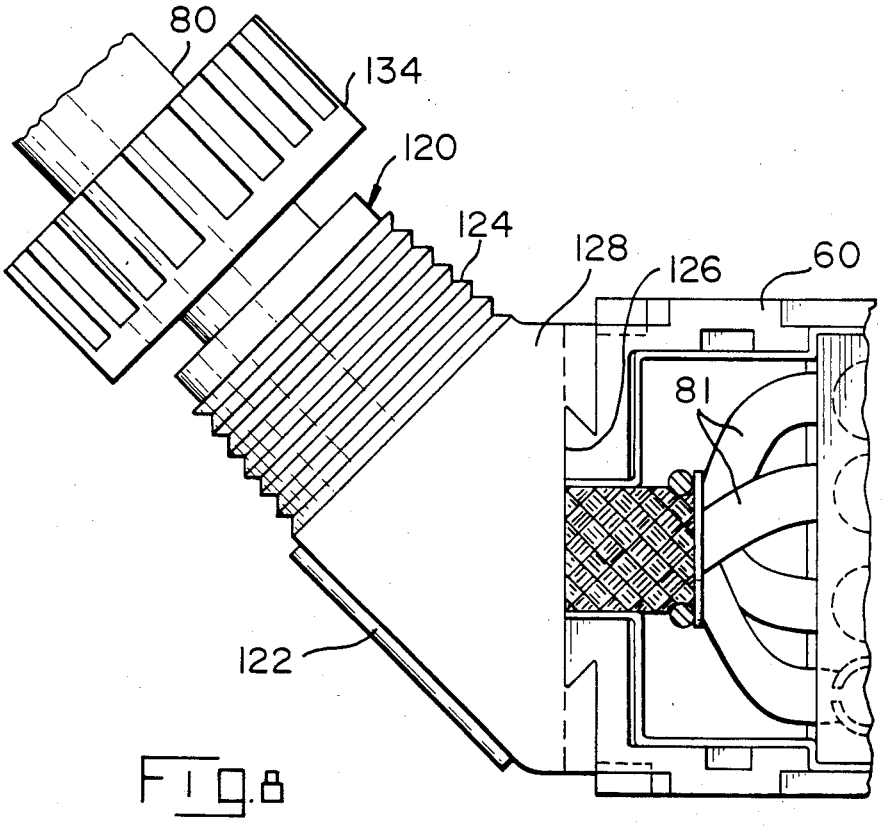
FIG. 8 is a plan view of an alternative inserter as assembled to the cable and lower cover.
Figure 9A:
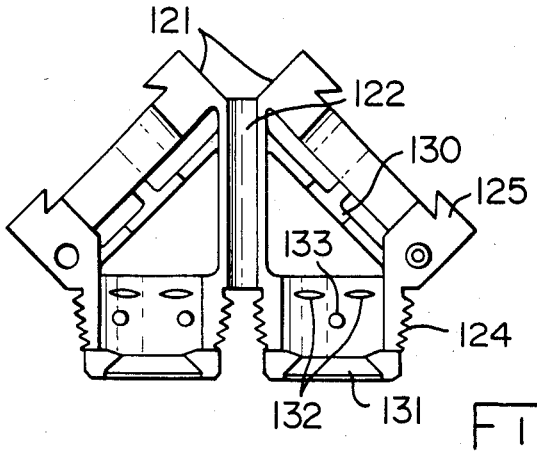
FIGS. 9A to 9D are views of the alternative inserter halves.
Figure 9B:
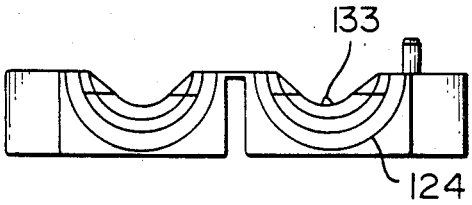
Figure 9C:
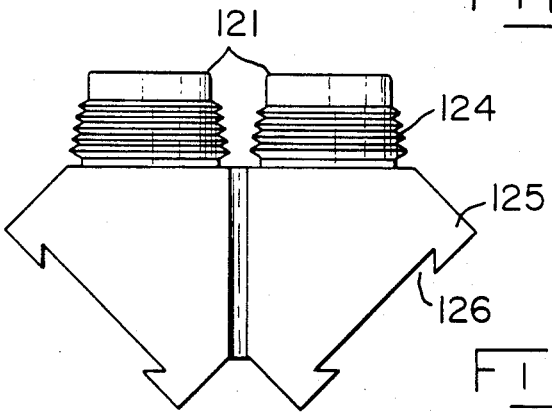
Figure 9D:
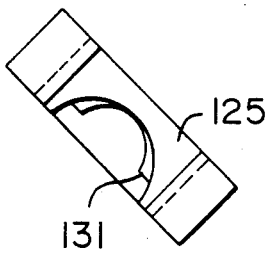

FIG. 8 depicts an alternative inserter 120 which provides for terminating the cable 80 at 45 degrees to the lower cover part 60. The inserter 120 comprises a threaded portion 124 which receives an internally threaded compression cap 134 and a mating portion 125 having a dovetail slot 126 which mates with flanges 72 as previously described. This inserter 120 can be inverted to permit termination cable 80 at a second orientation 45 degrees to the lower cover part. Cable clamping to provide strain relief for termination of conductors 81 is provided by applying compression nut to threaded portion 124.

Referring to FIGS. 9A to 9D, the alternative inserter 120 is conveniently molded in two halves 121 connected by a hinge 122. Each half 121 has a cable receiving bore portion 128 which in cooperation with the other bore portion forms a passage through the assembled inserter 120. Each bore portion is profiled with flanges 130, 131, ridges 132,, and a spike 133 for progressively bearing on the outer jacket of cable 80 as nut 134 (FIG. 8) is threaded into position. This arrangement eliminates the need for a strain relief ferrule 84 as previously described.

I claim:

1. A shielded electrical connector assembly of the type having a forward mating portion and a rear cable connecting portion, the assembly being matable with a like corresponding connector assembly and comprising a terminal housing, upper and lower ground shields, and upper and lower insulative cover parts, the lower ground shield having a base panel with a pair of sidewalls and a rearwall upstanding therefrom, and a forward contact portion extending away from said rearwall, the lower cover part having a base panel with a pair of sidewalls and rearwall upstanding therefrom, the panel, sidewalls, and rearwall of said lower shield fitting against the panel, sidewalls, and rearwall of said lower cover when said connector is assembled, the forward contact portion fitting against said housing, the housing having a terminal support platform flanked by a pair of upstanding sidewalls bridged by a hood toward the forward end thereof, the upper shield having forward contact portions which fit against said hood facing said platform, said forward contact portions of said upper shield engaging like corresponding forward contact portions of a like corresponding lower shield when said connector is mated with a like corresponding connector, the connector further comprising terminals disposed on the terminal support floor and resilient contact portions extending to the mating face for contact with like contact portions on a mating contact, and a shunt bar extending across the terminals selectively commoning pluralities of terminals when in the unmated position. the connector being characterized in that:

said lower shield has a pair of wings extending forward from respective sidewalls thereof, said wings being assembled against respective sidewalls of said housing to lie between said terminal support platform and said hood, each wing having a flange lying against the respective housing sidewall and a resilient tongue which extends beyond said sidewall for engaging the flange on the wing in a like corresponding connector hermaphroditically connectable therewith the shunt bar comprising a dielectric carrier having a plurality of conductive shunt contacts thereon for contact with respective terminals, the shunt bar being disposed between said shielding wings with the shunt contacts in a non-contacting relation with said shielding wings, the shunt bar further comprising means to attach the shunt bar to the housing.

2. The connector of claim 1 wherein the conductive shunt contacts are stamped and formed and extend downwardly form a conductive bar.

3. The connector of claim 2 wherein the shunt bar comprises two stamped and formed conductive bars having said shunt contacts, the conductive bars having a dielectric member disposed therebetween, the conductive bars being overlapped and assembled such that alternating terminals in the housing are contacted.

4. The connector of claim 1 wherein the attachment means on the shunt bar comprises latch members engageable with detents located in the housing.

5. A hermaphroditic electrical connector of the type comprising a terminal housing having a terminal support floor, and sidewalls extending upwardly therefrom, contacts mounted within a terminal cavity on the terminal support floor having a resilient tongue portion extending forwardly into a front mating face, the terminal resilient tongue portions for contacting like resilient tongues of a matable hermaphroditic connector, the connector further comprising a shunting means extending transverely above the terminals to selectively and electrically common terminals disposed in the terminal cavity, the connector further comprising a lower shield member comprising a shield floor and shield side walls, and forward contact portions extending forwardly from the shield floor towards the front mating face for contacting forward contact shield portions on like matable connectors, the shield members for electrically shielding the terminals, and a lower cover member to hold the lower shield and terminal housing, the connector being characterized in that the terminal housing includes an entry from the terminal cavity adjacent to the sidewalls extending forward to the mating face and the terminal housing sidewalls include rearwardly facing shoulders proximate the mating face the terminal housing support floor including a post member extending upwardly therefrom, the lower shield member comprising forward wing portions extending from the shield sidewalls forwardly towards the mating face, the forward wing portions having bends to form rearwardly facing shoulders, the wing portions being slidably receivable into the terminal receiving cavity to a point where the rearwardly facing shoulders on the wing portions abut the rearwardly facing shoulders on the terminal housing sidewalls, the shunting means being disposed in the terminal housing such that ends of the shunting means abut the rearwardly facing shoulders on the shield wing portions and the post member thereby trapping the shield member within the terminal housing, the forward wing portions having forward contact portions extending through the entry between the sidewalls and between the terminal resilient portions, the forward contact portions profiled to overlappingly contact the forward contact portions on a like hermaphroditic connector matable along an axial line, each forward contact portion extending from the wing portions comprising a static component and a resilient component, the resilient components being deflectable by the static components of a like connector upon mating when the mating face of the matable connector is axially rotated 180 degrees with respect to the mating face of said connector.

6. The connector of claim 5 wherein the static component extending from each shield sidewall comprises an upper flange portion having an outwardly curled lip portions and each resilient portion comprises a lower tongue portion radiused outwardly, the lower tongue portions and the lip portions being cooperatively profiled to overlappingly mate with a matable hermaphroditic connector, the lip portions resiliently deflecting the radiused portions inwardly, the radiused portion thereafter slidable along the flange portion.

7. The connector of claim 5 wherein the terminal housing includes slot means extending through the housing to the front mating face, for receiving therethrough the forward contact portions of the lower shield member.

* * * * *